United States Patent [19]

Costa

[11] 4,155,387

[45] May 22, 1979

[54] GOLF BAG INSERT

[76] Inventor: Raymond Costa, 2627 1st Ave., East Meadow, N.Y. 11554

[21] Appl. No.: 921,634

[22] Filed: Jul. 3, 1978

[51] Int. Cl.[2] ..... A63B 55/00

[52] U.S. Cl. ..... 150/1.5 R

[58] Field of Search ..... 150/1.5 R, 1.5 B, 1.5 C; 190/51; 220/22

[56] References Cited

U.S. PATENT DOCUMENTS

| | | | |
|---|---|---|---|
| 1,382,634 | 6/1921 | Fernandez | 220/22 |
| 1,599,170 | 9/1926 | Fatjo | 150/1.5 R |
| 2,105,853 | 1/1938 | Brodie | 150/1.5 R |
| 2,722,258 | 11/1955 | Smidt | 150/1.5 R |
| 2,751,955 | 6/1956 | Nahon | 150/1.5 R |
| 3,674,072 | 7/1972 | Shuto | 150/1.5 R |
| 4,130,153 | 12/1978 | Zopf | 150/1.5 R |

*Primary Examiner*—Donald F. Norton
*Attorney, Agent, or Firm*—Nolte & Nolte

[57] ABSTRACT

A device is provided for disposition in the bottom of a golf bag to keep the club shafts separated. Means are provided for adjusting the dimensions of the device so that it may be disposed in different golf bags. A golf bag including the device is also disclosed.

5 Claims, 2 Drawing Figures

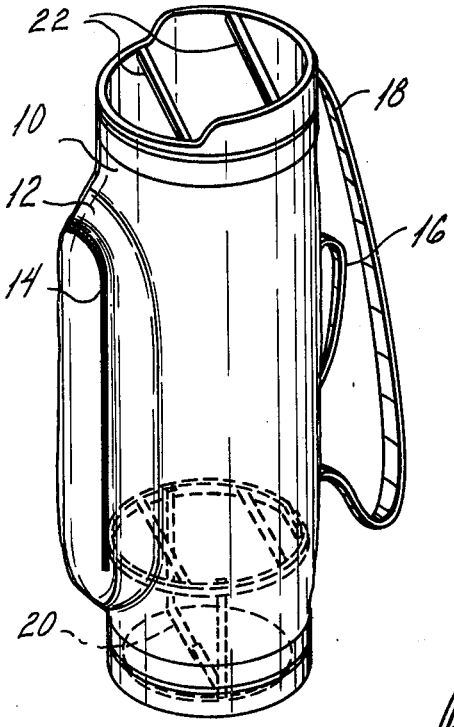
FIG. 1
FIG. 2
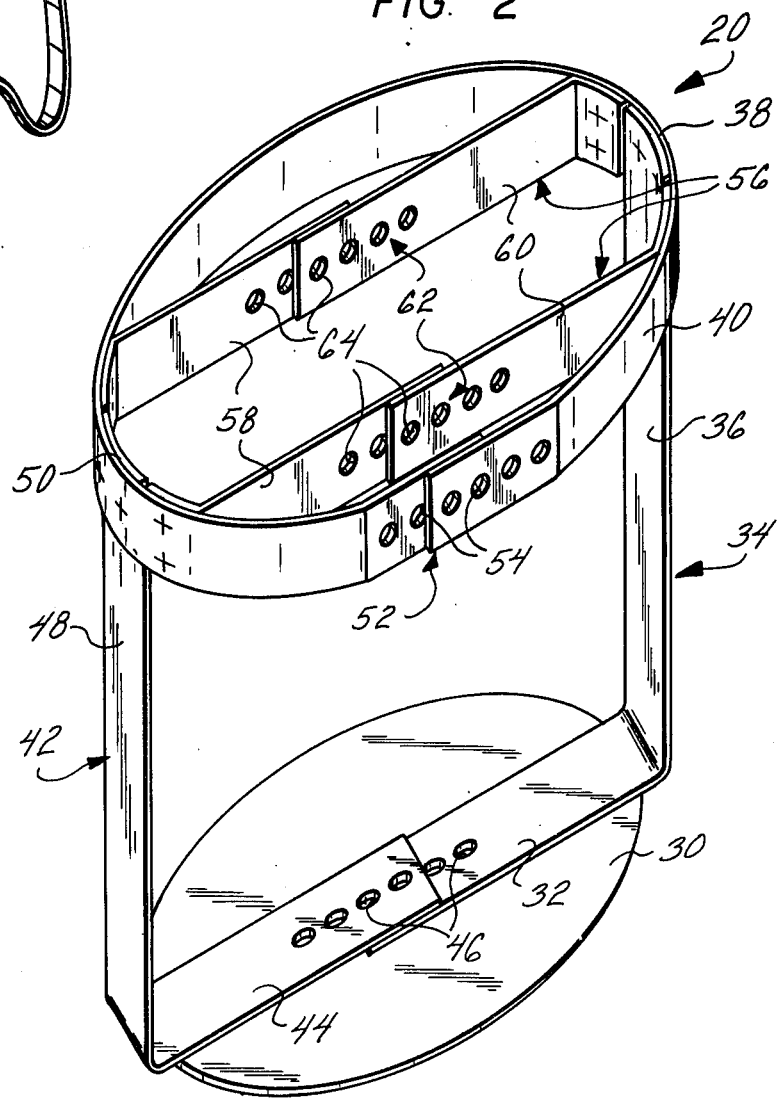

GOLF BAG INSERT

BACKGROUND OF THE INVENTION

This invention is concerned with an insert for a golf bag with a golf bag having such an insert, the insert being effective to maintain different clubs separate within the bag. The desirability of keeping different types of golf clubs segregated within the golf bag is well recognized and techniques adopted in the prior art to this end are shown in the following U.S. Pat. Nos.:

| | |
|---|---|
| 3,164,185 (Ingoldt) | 3,348,857 (Rollin) |
| 3,842,876 (Cristelli) | 3,954,239 (Kerbs) |
| 3,985,373 (Widegren) | 3,139,132 (Schiller) |
| 3,154,314 (McCune) | 1,726,245 (Shelton) |
| 2,774,403 (Williamson) | 2,781,072 (Kouke) |
| 2,482,372 | |

Each of the above mentioned patents shows a technique for holding either groups of clubs separate from other groups of clubs or for holding individual clubs or similar items. Each one of those patents shows a structure which is built into the golf bag. As is well known, a golf bag is a relatively expensive item and the purchase of a new bag simply to obtain this feature, desirable as it is, is in many cases prohibitive.

I seek to provide a simple and effective insert for disposition within an existing golf bag which is effective to maintain the clubs segregated within the bag.

BRIEF SUMMARY OF THE INVENTION

I provide a device for insertion into the bottom of a golf bag which includes partition means for extending across the golf bag to define zones within which the clubs may be disposed and means are provided so that the device can be adjusted to be supported within golf bags of different sizes.

DESCRIPTION OF THE FIGURES OF THE DRAWINGS

FIG. 1 is a perspective view of a golf bag embodying the present invention; and

FIG. 2 is a perspective view, on a much larger scale than FIG. 1, showing the insert of the bag of FIG. 1.

DESCRIPTION OF THE PREFERRED EMBODIMENT

The bag in FIG. 1 has a main, club carrying compartment 10, an accessory compartment 12 provided with a sliding clasp fastener 14 for containing accessories such as a supply of balls, a towel and a rain jacket. Secured to the main body of the bag is a handle 16 and a shoulder strap 18. Within the lower portion of the bag is disposed an insert 20 described in greater detail with reference to FIG. 2. Partition elements 22 are removably disposed in the opening at the upper end of the compartment 10.

It will be recognized that the partition elements 22, which are common in golf bags, are effective to maintain the heads of the clubs separate but, of course, the grips of the clubs may move freely within the lower part of the bag.

The insert 20 is effective to maintain the grips of the various clubs separate. That insert, as can be seen in FIG. 2 comprises a base 30 adapted to be disposed on the interior bottom surface of the bag. One limb 32 of an L-shaped strap 34 is permanently secured to the base 30 and the other limb 36 of that member is secured as at 38 to a closed band or hoop 40.

A second L-shaped strap member 42, generally similar to member 34, has one limb 44 horizontal and overlying the limb 32. Limbs 32 and 44 are each provided with openings 46 selected ones of which may be brought into register so that the members 34 and 42 may be secured to one another by passing a screw threaded element through the registered openings. The screw threaded element may comprise a screw engaging with appropriate screw threads in the holes in limb 32 or a nut and bolt arrangement may be utilized with the holes 46 extending additionally through the base 30.

Limb 48 of member 42 is secured as at 50 to the band or hoop 40 at a location diametrically opposed to the connection of the limb 36 of element 34.

Terminal end portions of the band 40 overlap as indicated generally at 52 and those portions have through holes 54 selected ones of which may be brought into register so that a nut and bolt or other screw element can be passed through those openings to fix the girth defined by the band. It will be appreciated that adjustment of the band will of course be accompanied by an adjustment of the members 34 and 42 and, as will be appreciated from the following description, additionally an adjustment of the separating elements 56.

Each separator 56 comprises two strap members 58 and 60 respectively, each of those elements being fixedly secured to the band 40 and projecting chordally across the area bound by the band. The inner portions of the straps 58 and 60 overlap as at 62 and those portions are provided with holes 64 selected ones of which may be brought into register so that the two straps of the separator may be connected by an appropriate screw threaded elements.

It will be appreciated that the insert illustrated in FIG. 2 is one which by appropriate adjustment of the band 40, the separators 56 and the elements 34 and 48 can be fitted to a number of bags differing quite widely in size. The insert will be disposed within a bag in such a manner that the separators 56 are parallel to and generally in a similar plane to the separating elements 22 at the top of the bag. In this way, three areas are defined within the bag within one of which putters and wedges would be disposed, within another of which the woods would be disposed and within the third of which irons would be disposed.

It will be recognized that the structure described hereabove can be altered in many ways well within the purview of one skilled in the art without deviating from the scope of the present invention. For example, while the illustrated embodiment is one suited for manufacture from aluminum extrusions, it is quite possible to produce such a unit of other materials as, for example, of molded plastics and in that case, the format of the adjustment means may be changed to accommodate the differences in material.

What is claimed is:

1. A golf bag comprising a main, club carrying compartment, said compartment having a closed bottom and an open top through which clubs are inserted into and withdrawn from the compartment, first separating means disposed adjacent the open top and defining zones of the compartment for the reception of different clubs and an insert disposed close to the bottom of the compartment and comprising separating means for defining regions in the lower-most part of the compartment for receiving golf clubs, support means for cooperation with the structure of the golf bag for supporting said separating means in position adjacent to the bottom of the compartment and adjustment means effective to permit the use of the insert with bags of different sizes.

2. A golf bag as claimed in claim 1, wherein said separating means of said insert comprises a hoop cooperating with the interior surface of said compartment and separating elements extending chordally across said hoop and wherein said adjustment means includes means for adjusting the girth of said hoop and means for adjusting the length of said elements extending chordally across said hoop.

3. An insert for a golf bag comprises separating means for defining regions for receiving golf clubs, support means for cooperation with the structure of a golf bag for supporting said separating means in a location close to the bottom of the bag, adjustment means effective to permit the use of the insert with bags of different sizes, said separating means comprising a hoop for cooperation with the interior surface of a golf bag and separating elements extending chordally across said hoop, said adjustment means including means for adjustment of the girth of the hoop, and means for adjusting the length of said elements extending chordally across said hoop.

4. Apparatus as claimed in claim 3 wherein said support means comprises a strap secured to said hoop and extending to a base, said base being for disposition on the bottom of a golf bag.

5. Apparatus as claimed in claim 4 wherein there are two such straps at spaced apart regions of said hoop, the connection of at least one of said straps to said base being adjustable.

* * * * *